US008998651B2

(12) United States Patent
Chen et al.

(10) Patent No.: US 8,998,651 B2
(45) Date of Patent: Apr. 7, 2015

(54) PLUG HAVING A BODY WITH A PLURALITY OF BARS IN A FIRST DIRECTION AND A SECOND DIRECTION EACH WITH A CHANNEL TO ACCOMMODATE A TERMINAL

(71) Applicant: Bellwether Electronic Corp., Taoyuan County (TW)

(72) Inventors: Kuan-Wu Chen, Taoyuan County (TW); Hsing-Yu Lee, Taoyuan County (TW)

(73) Assignee: Bellwether Electronic Corp., Taoyuan County (TW)

( * ) Notice: Subject to any disclaimer, the term of this patent is extended or adjusted under 35 U.S.C. 154(b) by 16 days.

(21) Appl. No.: 13/938,353

(22) Filed: Jul. 10, 2013

(65) Prior Publication Data

US 2015/0017841 A1 Jan. 15, 2015

(51) Int. Cl.
*H01R 13/64* (2006.01)

(52) U.S. Cl.
CPC ..... *H01R 13/64* (2013.01)

(58) Field of Classification Search
CPC ..... H01R 13/629; H01R 23/7005
USPC ..... 439/677–681
See application file for complete search history.

(56) References Cited

U.S. PATENT DOCUMENTS

| | | | | |
|---|---|---|---|---|
| 6,196,874 | B1 * | 3/2001 | Wu | 439/607.58 |
| 6,471,530 | B1 * | 10/2002 | Gimbatti et al. | 439/196 |
| 7,909,652 | B2 * | 3/2011 | Yang et al. | 439/660 |
| 8,092,261 | B2 * | 1/2012 | Lord | 439/680 |
| 8,449,312 | B2 * | 5/2013 | Lang et al. | 439/352 |

* cited by examiner

*Primary Examiner* — Chandrika Prasad
(74) *Attorney, Agent, or Firm* — Chun-Ming Shih; HDLS IPR Services

(57) ABSTRACT

An electric power plug includes an insulative body having a first bar and a second bar at a space. The first bar is longitudinally formed with only one first channel for receiving a first plug terminal. The second bar is longitudinally formed with a plurality of second channels for receiving a plurality of second plug terminals. An electric power receptacle includes an insulative seat having a first trough for connecting the first bar and a second trough for connecting the second bar. The first and second troughs are arranged at a space. The first trough is provided with only one first receptacle terminal. The second trough is provided with a plurality of second receptacle terminals which are parallel with each other and arranged at a space.

10 Claims, 9 Drawing Sheets

PLUG HAVING A BODY WITH A PLURALITY OF BARS IN A FIRST DIRECTION AND A SECOND DIRECTION EACH WITH A CHANNEL TO ACCOMMODATE A TERMINAL

BACKGROUND OF THE INVENTION

1. Technical Field

The invention relates to electric connectors, particularly to connectors for electric power.

2. Related Art

A conventional power connector is composed of a plug and a receptacle. Such a connection interface is symmetric and has no foolproof mechanism. Misconnection tends to occur because of users' or workers' errors. Misconnection may cause serious damage for hardware and/software.

SUMMARY OF THE INVENTION

An object of the invention is to provide a power connector, which is provided with a misconnection-proof mechanism. This can prevent the connector from being erroneously connecting.

To accomplish the above object, the plug of the invention includes an insulative body having a first bar and a second bar at a space. The first bar is longitudinally formed with only one first channel for receiving a first plug terminal. The second bar is longitudinally formed with a plurality of second channels for receiving a plurality of second plug terminals. The receptacle of the invention includes an insulative seat having a first trough for connecting the first bar and a second trough for connecting the second bar. The first and second troughs are arranged at a space. The first trough is provided with only one first receptacle terminal. The second trough is provided with a plurality of second receptacle terminals which are parallel with each other and arranged at a space.

In the invention, the second bar cannot be inserted into the first trough. As a result, the plug and receptacle can be connected only in a correct direction.

DETAILED DESCRIPTION OF THE INVENTION

Figure 1:
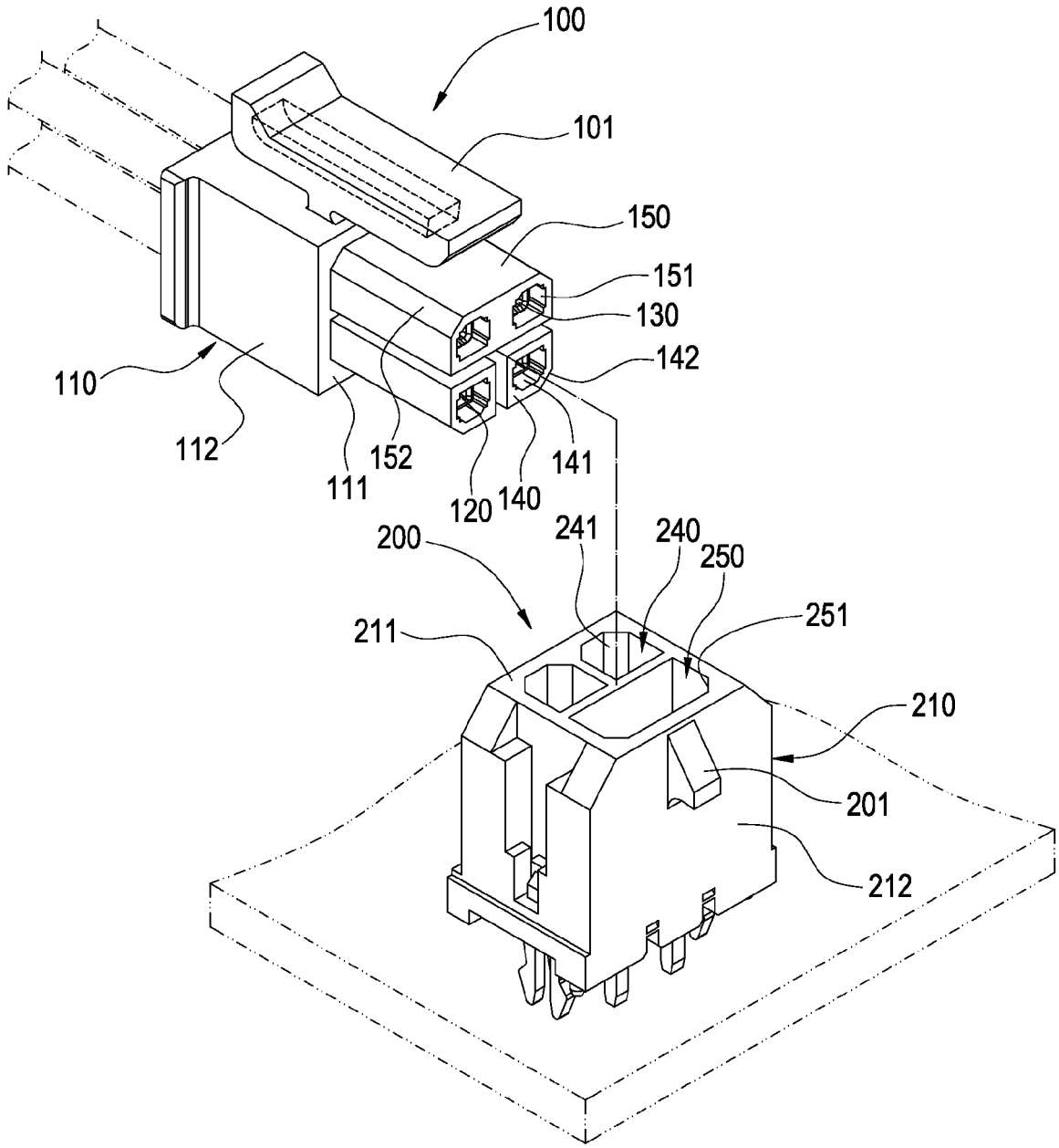
FIG. 1 is a perspective view of the plug and receptacle of the first embodiment of the invention.
Figure 2:
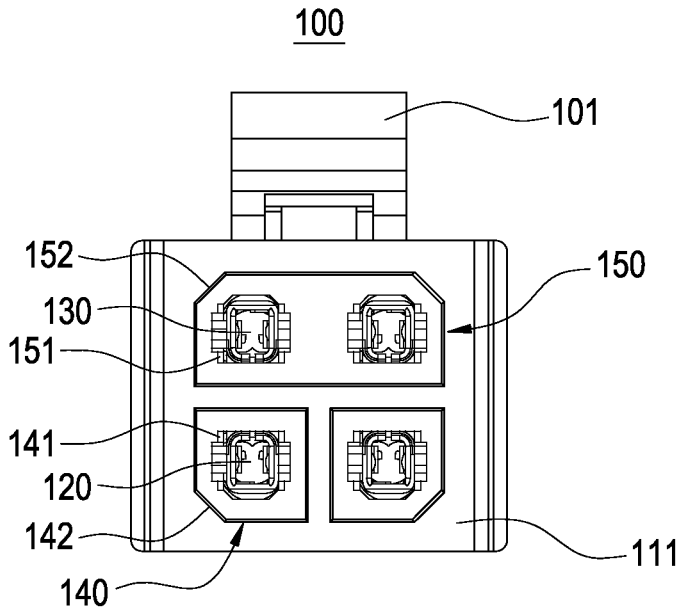
FIG. 2 is a plan view of the plug of the first embodiment of the invention.
Figure 3:
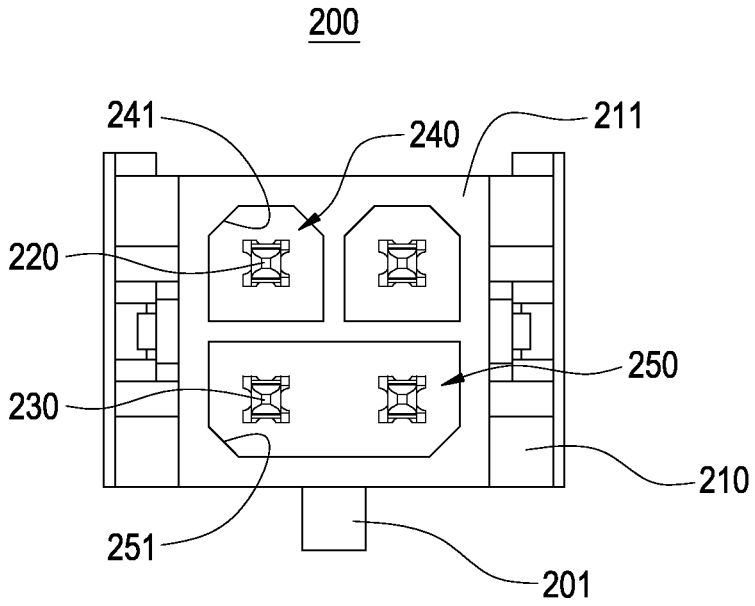
FIG. 3 is a plan view of the receptacle of the first embodiment of the invention.

Please refer to FIGS. 1-4, which show the first embodiment of the invention. The power connector 100 of the invention includes a plug 110 and a receptacle 200. The plug 100 includes an insulative body 110, two first plug terminals 120 and two second plug terminals 130.

The insulative body 110 is a substantial hexahedron, which is preferably made of plastic. The insulative body 110 has a body top 111 and four body sides 112 around the body top 111. The body sides 112 perpendicularly connect to the body top 111. Two first bars 140 and a second bar 150 are extended from the body top 111. One of the body sides 112 is formed with a hooked rod 101. Preferably, the hooked rod 101 extends over the body top 111. The first bars 140 and second bar 150 are arranged at a space. The first bars 140 are cuboids. Each of the first bars 140 is longitudinally formed with only one first channel 141. Preferably, two angles of each of the first bars 140 are separately formed with two first outer chamfers 142. The second bar 150 is a cuboid. A width of at least one edge of the second bar 150 is greater than a maximum width of an edge of the first bar 140. The second bar 150 is longitudinally formed with two second troughs 151. Preferably, the two second troughs 151 are parallel with each other and arranged at a space. Two angles of each of the second bar 150 are separately formed with two second outer chamfers 152. In this embodiment, the first channels 141 and second troughs 151 are parallel. Preferably, the first channels 141 are arranged in a row and the second troughs 151 are arrange in another row.

The first and second plug terminals 120, 130 are sleeves made of metal. Each of the first plug terminals 120 is received in one of the first channels 141. Each of the second plug terminals 130 is received in one of the second troughs 151.

The receptacle 200 is used to connect the plug 100 and includes an insulative seat 210, two first receptacle terminals 220 and two second receptacle terminals 230.

The insulative seat 210 is a substantial hexahedron, which is preferably made of plastic. The insulative seat 210 has a seat top 211 and four seat sides 212 around the seat top 211. A first trough 240 for being inserted by the first bar 140 and a second trough 250 for being inserted by the second bar 150 are extended from the seat top 211. One of the seat sides 212 is formed with a hooked protrusion 201 for engaging with the hooked rod 101. The first and second troughs 240, 250 are arranged at a space and correspond to the first and second bars 140, 150. Preferably, there are two first troughs 240 and a second trough 250. Preferably, two angles of each of the first troughs 240 are separately formed with two first inner chamfers 241 corresponding to the first outer chamfers 142. Each of the second troughs 250 is longitudinally formed with two second troughs 151. Preferably, the two second troughs 151 are parallel with each other and arranged at a space. Two angles of each of the second troughs 150 are separately formed with two second inner chamfers 251 corresponding to the second outer chamfers 152.

The first receptacle terminals 220 are poles made of metal and have an outline corresponding to the first plug terminals 120. Each of the first receptacle terminals 220 is received in one of the first troughs 240.

The second receptacle terminals 230 are poles made of metal and similar to the first receptacle terminals 220 in structure. The second receptacle terminals 230 are used to connect the second plug terminals 130. The second receptacle terminals 230 are received in the second trough 250. The second receptacle terminals 230 are parallel and arranged in a row. Each of the first receptacle terminals 220 passes through the bottom of the first trough 240. Each of the second receptacle terminals 230 passes through the bottom of the second trough 250.

Figure 4:
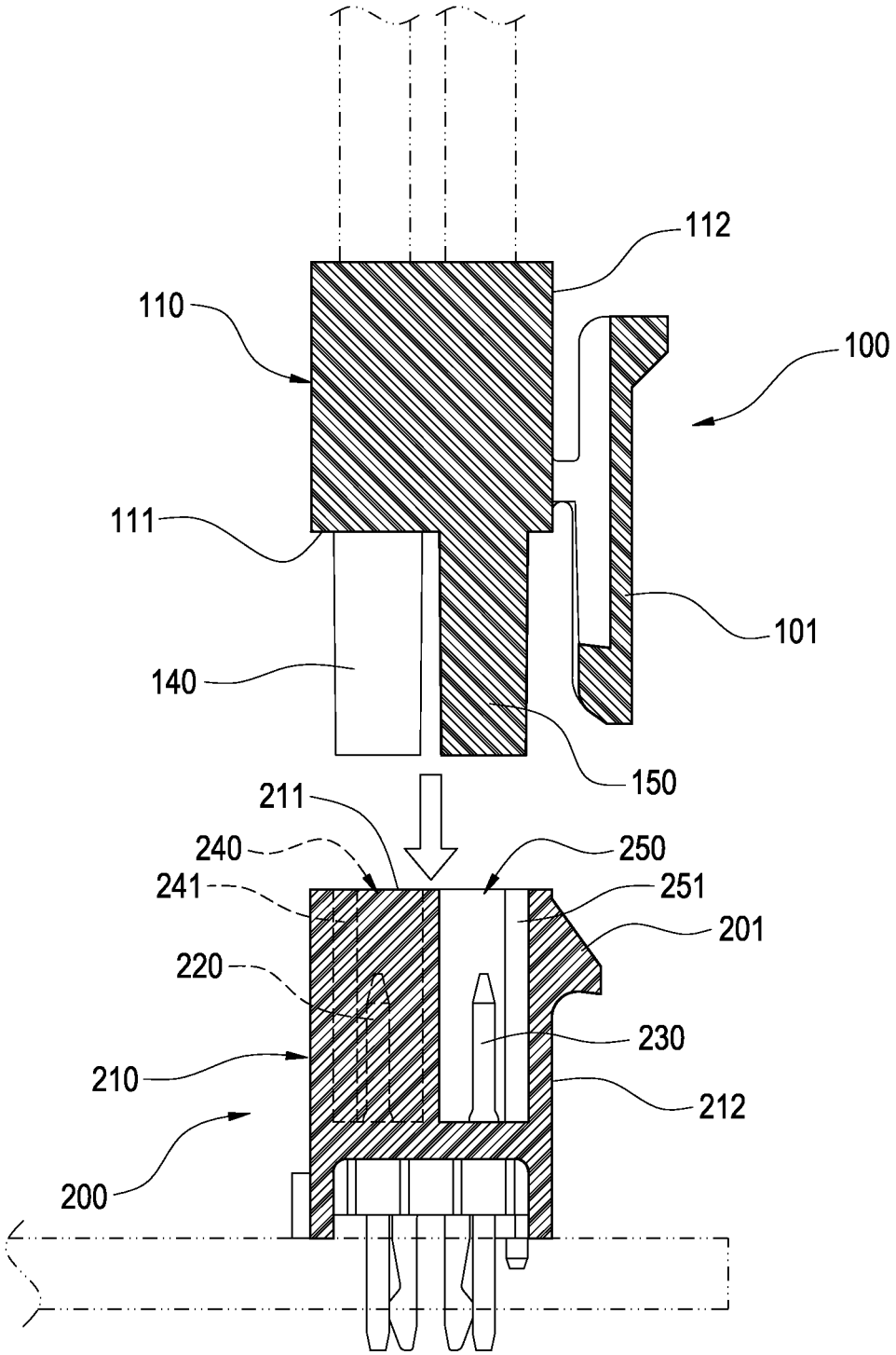
FIG. 4 is a schematic view of the plug and receptacle of the first embodiment of the invention.
Figure 5:
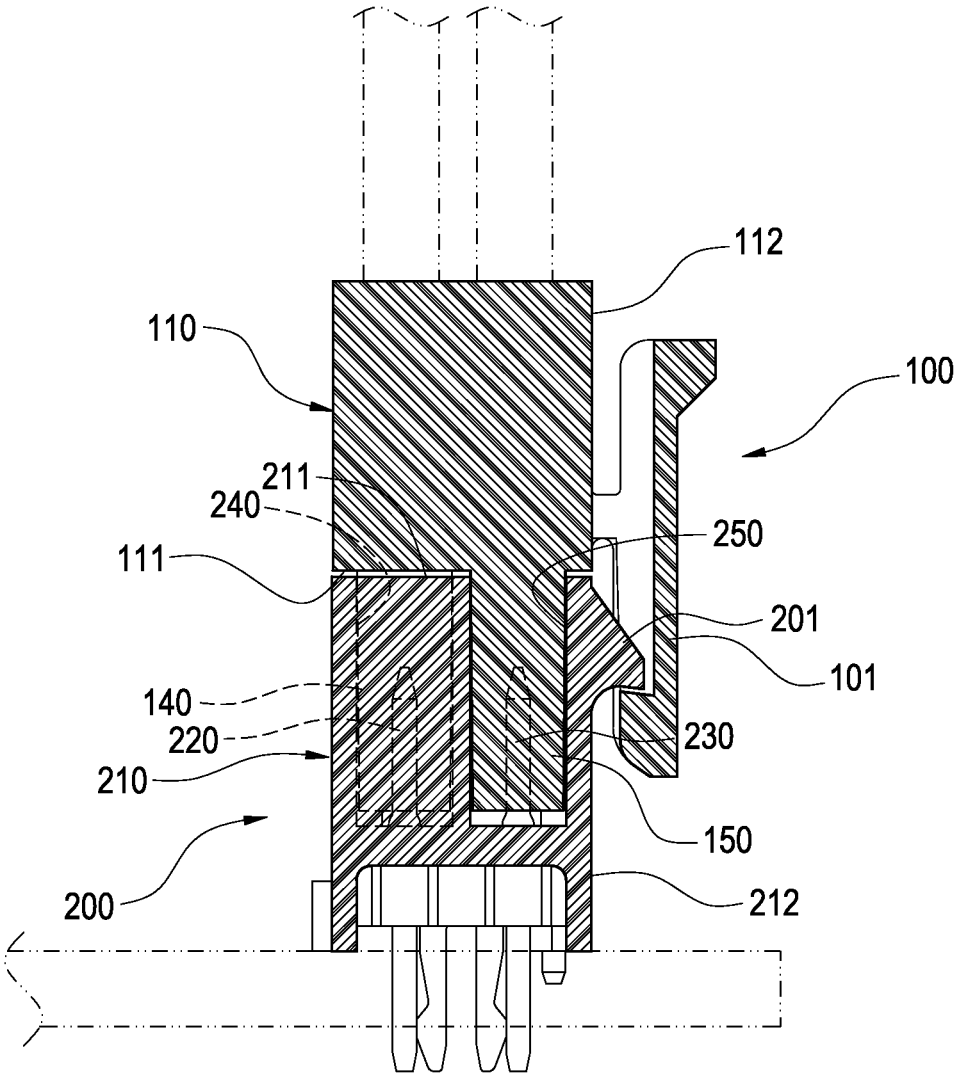
FIG. 5 is another schematic view of the plug and receptacle of the first embodiment of the invention.

Please refer to FIGS. 4 and 5. When the plug 100 and the receptacle 200 are coupled in a correct direction, the first bars 140 and the second bar 150 are inserted into the first troughs 240 and the second trough 250, respectively. And the hooked rod 101 engages with the hooked protrusion 201 so that the plug 100 can firmly couple with the receptacle 200.

Figure 6:
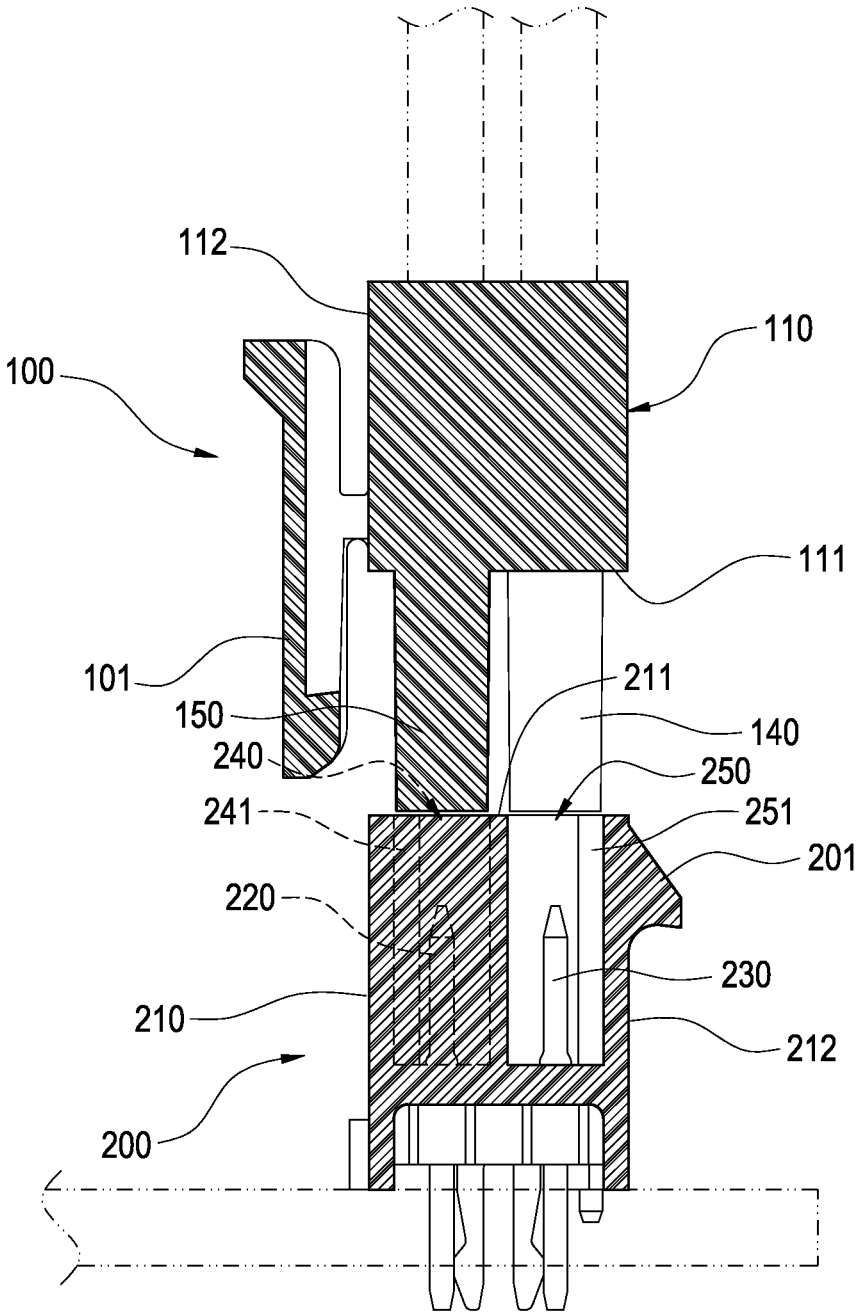
FIG. 6 is a schematic view showing misconnection of the plug and receptacle of the first embodiment of the invention.

Please refer to FIG. 6. When the plug 100 and the receptacle 200 are coupled in an incorrect direction, the second bar 150 cannot be inserted into the first trough 240. Furthermore, because the first bar 140 has the first outer chamfer 142 and the first trough 240 has the first inner chamfer 241, the first bar 140 cannot be inserted into the first trough 240. As a result, the invention allows the plug 100 and receptacle 200 to be coupled only in a correct direction.

Figure 7:
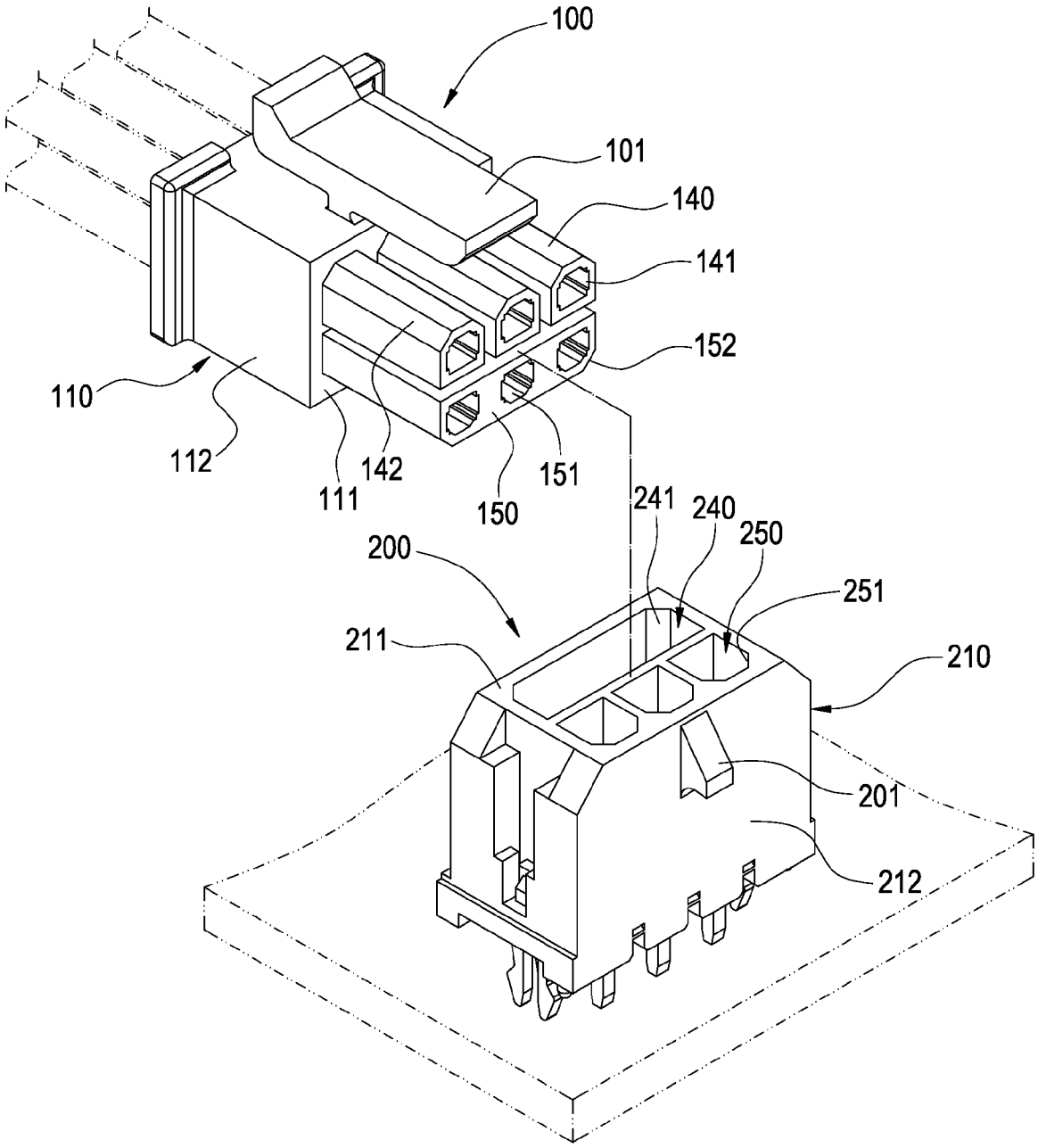
FIG. 7 is a perspective view of the plug and receptacle of the second embodiment of the invention.
Figure 8:
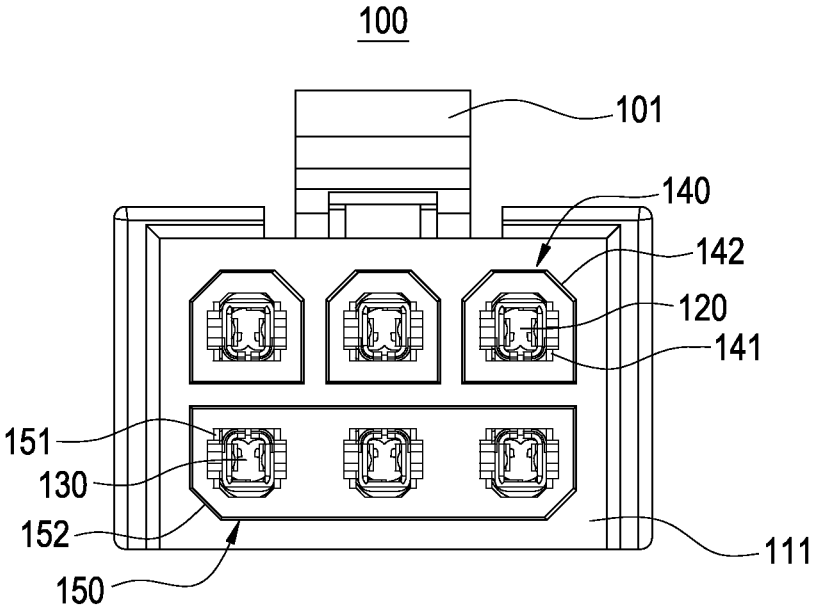
FIG. 8 is a plan view of the plug of the second embodiment of the invention.
Figure 9:
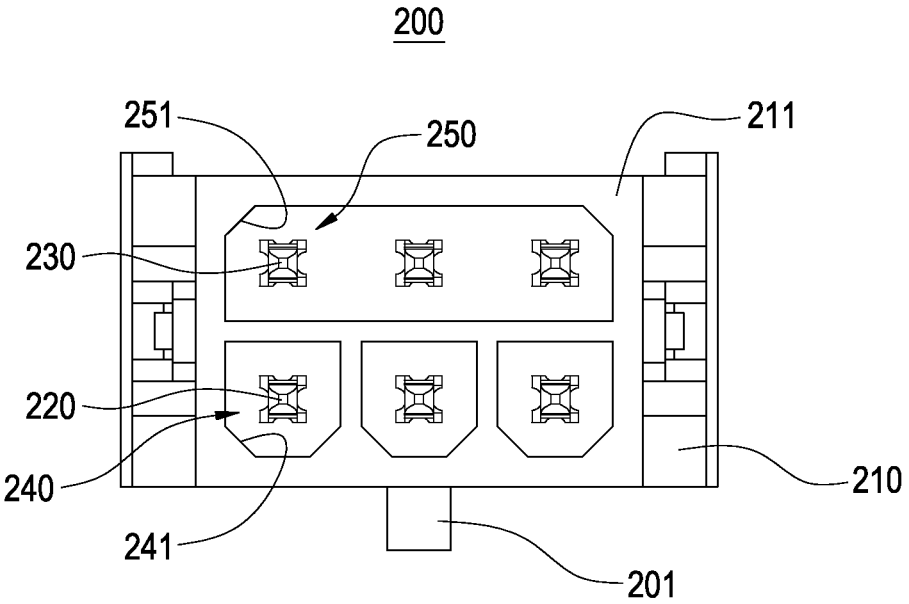
FIG. 9 is a plan view of the receptacle of the second embodiment of the invention.

Please refer to FIGS. 7-9, which show a second embodiment of the invention. In this embodiment, the insulative body 110 of the plug 100 has three first bars 140 and a second bar 150. Each of the first bars 140 receives one of the first plug terminals 120. The second bar 150 has three second channels 151 for separately receiving the three second plug terminals 130. The first and second plug terminals 120, 130 are separately arranged in two rows. The receptacle 200 corresponds to the plug 100. The insulative seat 210 is formed with three first troughs 240 and a second trough 250. Each of the first troughs 240 receives one of the first receptacle terminals 220 and the second trough 250 receives three first receptacle terminals 220.

Figure 10:
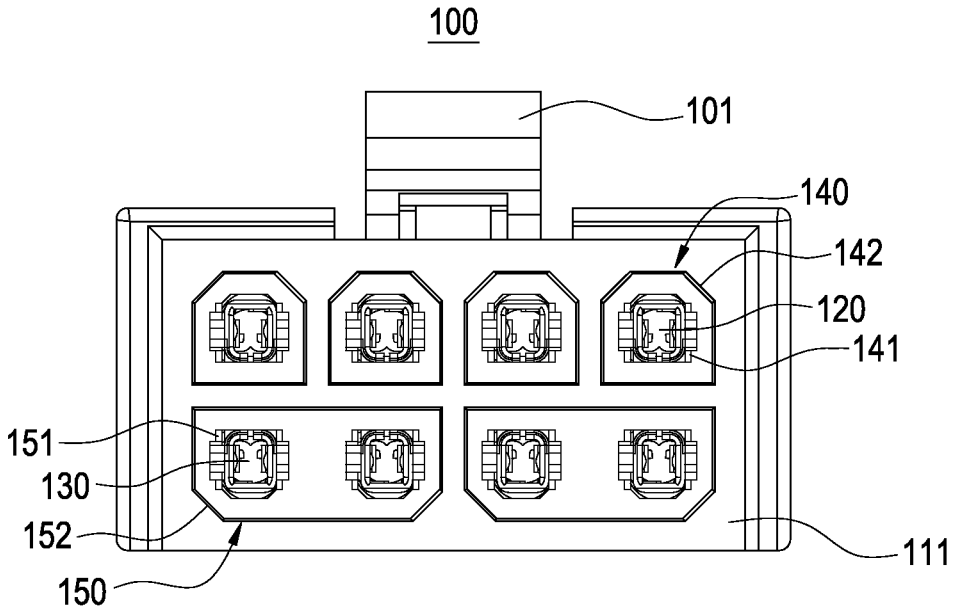
FIG. 10 is a plan view of the plug of the third embodiment of the invention.
Figure 11:
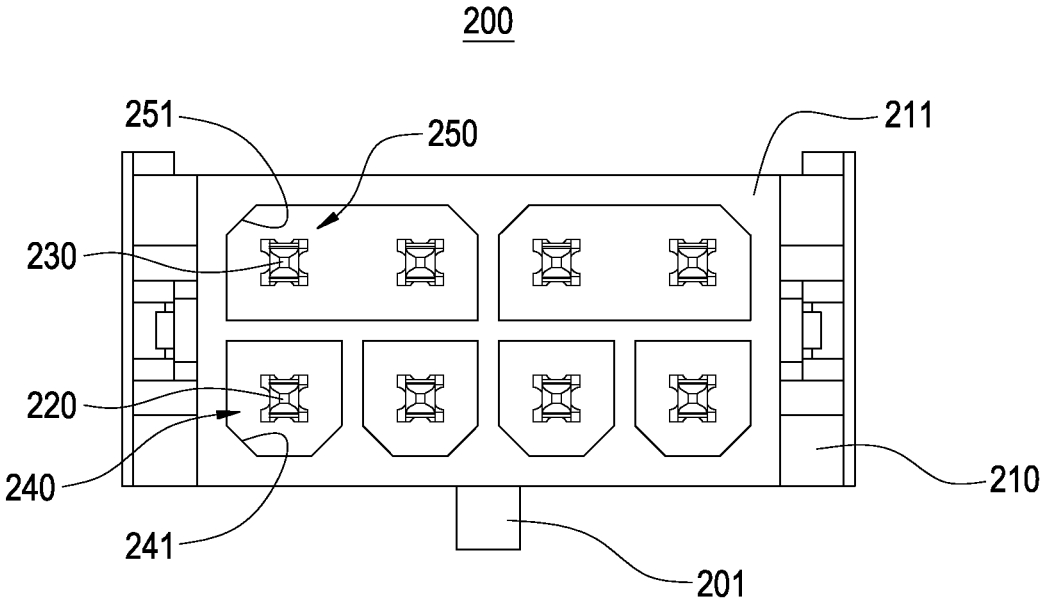
FIG. 11 is a plan view of the receptacle of the third embodiment of the invention.

Please refer to FIGS. 10-11, which show a third embodiment of the invention. In this embodiment, the insulative body 110 of the plug 100 has four first bars 140 and two second bars 150. Each of the first bars 140 receives one of the first plug terminals 120. Each of the second bars 150 has two second channels 151 for separately receiving the two second plug terminals 130. The first and second plug terminals 120, 130 are separately arranged in two rows. The receptacle 200 corresponds to the plug 100. The insulative seat 210 is formed with four first troughs 240 and two second troughs 250. Each of the first troughs 240 receives one of the first receptacle terminals 220 and each of the second troughs 250 receives two first receptacle terminals 220.

Figure 12:
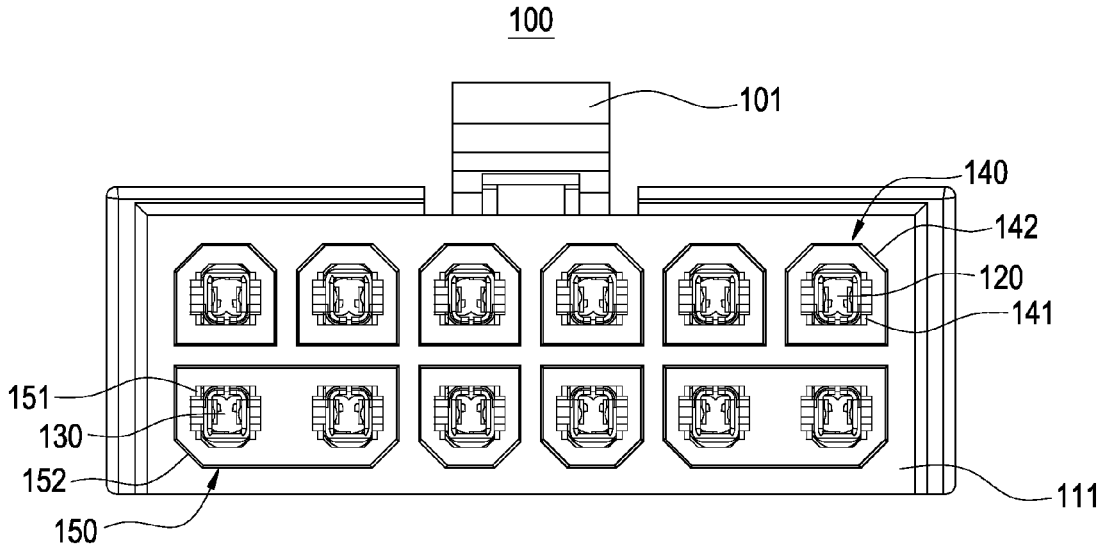
FIG. 12 is a plan view of the plug of the fourth embodiment of the invention.
Figure 13:
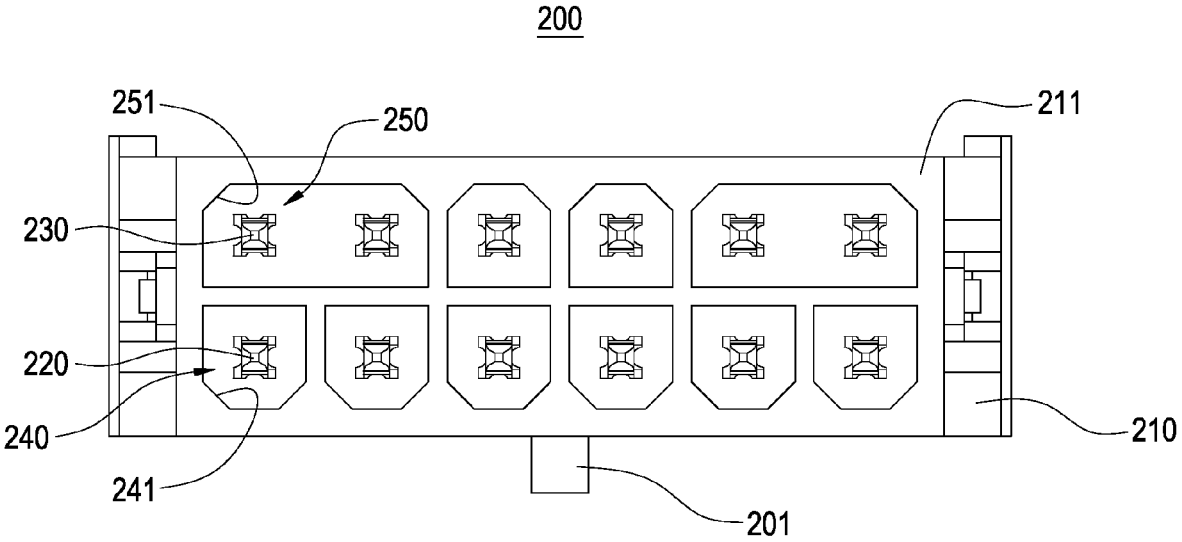
FIG. 13 is a plan view of the receptacle of the fourth embodiment of the invention.

Please refer to FIGS. 12-13, which show a fourth embodiment of the invention. In this embodiment, the insulative body 110 of the plug 100 has eight first bars 140 and two second bars 150. Each of the first bars 140 receives one of the first plug terminals 120. Each of the second bars 150 has two second channels 151 for separately receiving the two second plug terminals 130. The first and second plug terminals 120, 130 are separately arranged in two rows. One row includes six first plug terminals 120 and the other row includes two first plug terminals 120 and four second plug terminals 130. The receptacle 200 corresponds to the plug 100. The insulative seat 210 is formed with eight first troughs 240 and two second troughs 250. Each of the first troughs 240 receives one of the first receptacle terminals 220 and each of the second troughs 250 receives two first receptacle terminals 220.

What is claimed is:

1. A plug of a power connector, comprising:

an insulative body, having a body top with at least two first bars and at least one second bar formed thereon, the at least two first bars being formed in a row along a first direction with a gap formed therebetween, the at least two first bars and the at least one second bar being formed in two adjacent rows along a second direction, each of the at least two first bars being longitudinally formed with only one first channel and having a first distal end surface in a longitudinal direction thereof, and the at least one second bar being longitudinally formed with a plurality of second channels and having a second distal end surface in the longitudinal direction thereof, the second distal end surface being flush with the first distal end surfaces of the at least two first bars, wherein the plurality of the second channels are arranged along the first direction, and a quantity of the first channels is the same as that of the second channels;

at least two first plug terminals, received in the at least two first channels respectively; and a plurality of second plug terminals, separately received in the second channels, wherein each of the first channels corresponds to a respective one of the plurality of second channels and is identical to each of the plurality of second channels, and wherein a width of the second distal end surface measured in the first direction equals a sum of widths of the first distal end surfaces measured in the first direction and a width of the gap measured in the first direction.

2. The plug of claim 1, wherein the insulative body is provided with a plurality of body sides around the body top, and one of the body sides is formed with a hooked rod.

3. The plug of claim 1, wherein an angle of each of the at least two first bars is formed with a first outer chamfer.

4. The plug of claim 1, wherein an angle of the second bar is formed with a second outer chamfer.

5. A receptacle of a power connector configured to receive the plug claimed in claim 1, comprising:

an insulative seat, having a seat top, the seat top being formed with at least two first troughs for connecting the at least two first bars respectively and at least one second troughs for connecting the at least one second bar, and the first and second troughs being arranged at a space;

at least two first receptacle terminals for connecting the at least two first plug terminals respectively, each of the at least two first troughs being provided with only one of the at least two first receptacle terminals; and a plurality of second receptacle terminals for connecting the plurality of second plug terminals, received in the at least one second trough, and the plurality of second plug terminals being parallel with each other and arranged at a space.

6. The receptacle of claim 5, wherein the insulative seat is provided with a plurality of seat sides around the seat top, and one of the seat sides is formed with a hooked protrusion.

7. The receptacle of claim 5, wherein each of the first receptacle terminals passes through a bottom of each of the at least two first troughs.

8. The receptacle of claim 5, wherein each of the second receptacle terminals passes through a bottom of the second trough.

9. The receptacle of claim 5, wherein an angle of each of the at least two first troughs is formed with a first inner chamfer.

10. The receptacle of claim 5, wherein an angle of the at least one second trough is formed with a second inner chamfer.

* * * * *